United States Patent [19]

Klassen

[11] Patent Number: 4,955,093

[45] Date of Patent: Sep. 11, 1990

[54] COMBINATION BATH TUB SHELF AND BENCH

[76] Inventor: Lorraine J. Klassen, 2430 Vineyard, Escondido, Calif. 92025

[21] Appl. No.: 218,580

[22] Filed: Jul. 13, 1988

[51] Int. Cl.[5] ..... A47K 3/022

[52] U.S. Cl. ..... 4/579

[58] Field of Search ..... 4/559, 578, 579; 248/441.1, 454, 460; 108/32

[56] References Cited

U.S. PATENT DOCUMENTS

| | | | |
|---|---|---|---|
| 1,944,049 | 1/1934 | Weiler | 4/559 X |
| 2,006,169 | 6/1935 | Harris-Jones | 4/559 |
| 2,167,795 | 8/1939 | Bentz | 248/441.1 X |
| 2,237,076 | 4/1941 | Kenney et al. | 4/579 |
| 2,302,806 | 11/1942 | Senter | 4/559 X |
| 3,123,935 | 3/1964 | Williams | 108/32 X |
| 3,239,850 | 3/1966 | Kiss | 4/559 |
| 3,376,009 | 4/1968 | Domino | 248/460 |
| 4,472,843 | 9/1984 | Chermak | 4/559 |

*Primary Examiner*—Charles E. Phillips
*Attorney, Agent, or Firm*—Charles C. Logan, II

[57] ABSTRACT

An elongated shelf member that may be positioned across the width of a bath tub. A reading easel is pivotally hinged to the top surface of the shelf member and it may be collapsed into a recess formed in the top surface of the shelf member so that it's top surface is flush therewith. The bottom surface of the shelf has a grid-like reinforcing frame integrally formed therewith to provide sufficient strength to the shelf member so that it may be used as a bench to sit upon while bathing in the bath tub. Position securing assemblies are attached to the bottom surface of the shelf member adjacent its opposite side edges and they are slidable inwardly and outwardly so that they may be positioned against the lateral side walls of bath tubs having different widths. Suction cups are attached to the position securing assemblies.

3 Claims, 1 Drawing Sheet

COMBINATION BATH TUB SHELF AND BENCH

BACKGROUND OF THE INVENTION

The invention relates to bath tubs and more specifically to a combination bath tub shelf and bench.

When a person is bathing and wishes to relax and read while in the bath tub, keeping the reading material dry is a problem. Propping material on the edge of the tub is impractical and can lead to accidental immersion of the reading material.

As a person bathes, personal grooming is difficult because the necessary materials, (mirrors, nail polish, cuticle care products,) etc. are not easily kept at hand.

Whenever elderly, handicapped or the young are bathed by another person, it is difficult to get them into and out of the bath tub with out straining the helper or risk of injury to the bather.

Applicant's invention provides a structure for solving some of the problems of the past and also offers conveniences not heretofore available. Bathers using the combination bath tub shelf and bench can set all personal grooming materials on the shelf member and its raised lip around its periphery will inhibit accidental dropping of these articles into the bathtub. Reading while in the bath tub is made simple and convenient with the reading easel that is pivotally attached to the top surface of the shelf member. Books or periodicals will remain perched at a proper reading angle and will not slide into the bath tub water as they are held in place by a groove in the top surface of the shelf member.

Because the bath tub shelf and bench is strengthened in its span across the bath tub width, it can support considerable weight. When used as a bench for sitting over the bath tub, it offers several benefits not heretofore available. Thus a person may sit or rest upon the shelf while in the bath tub. This application of the device is of considerable advantage to elderly and handicapped persons who wish to bathe but may have difficulty getting into and out of the tub. The shelf provides a structure for sitting and sponge bathing while soaking ones feet.

Persons bathing infants can use the shelf to rest the child upon it while washing and applying childcare products. The shelf also serves as a convenient portable platform for washing the child while in the tub.

There is, therefore, a need for the applicant's novel device which can facilitate bathing and serve as a convenience item at the same time. The device is capable of being sat upon, used as a support for reading material and finally as an organizer for personal grooming articles while the user is bathing.

SUMMARY OF THE INVENTION

Applicant's novel combination bath tub and bench is formed of a shelf member made of plastic or other material of a sufficient length to span the width of a bath tub. The upper portion or surface of the device has a raised lip all around its perimeter to aid in keeping items on the surface of the invention. The upper surface of the shelf also incorporates a reading easel which is collapsible into a recess formed in the top surface of the shelf member. The reading easel is capable of multiple angles of elevation. This is possible since the support leg is adjustable and fits into a notched track for the proper angle of adjustment to suit the need of the individual reader. To use, a person merely lifts the reading platform from a recessed opening in the top of the shelf member and places the support leg in the desired notch. The bottom edge of books or other reading material is kept in place by a groove located just in front of the reading easel.

The bottom surface of the shelf has twin moveable position securing assemblies. They are equipped with small suction cups to hold the shelf firmly in place against the lateral sides of the bath tub while in use. These position securing assemblies can be adjusted inwardly or outwardly to accommodate any size bath tub and when in position will prevent the device from moving laterally in the tub. In order to adjust the position securing assemblies, the user unscrews the set-screw located centrally on each of the spacer bars. Once the set screw has been unloosened, the spacing bars can slide inwardly and outwardly on slide tracks located on the underside of the shelf. The user of the shelf adjusts the spacing bars to accommodate the dimensions of the tub. When the adjustment is made, the set screw is tightened and the suction cups are fixed to the side walls of the bath tub.

The bath tub shelf incorporates an X-shaped grid-like reinforcing frame on its bottom surface which is molded into the bath tub shelf for added strength. This strengthening structure will permit the user to sit on the device to soak his feet, sponge bathe, etc.

Figure 1:
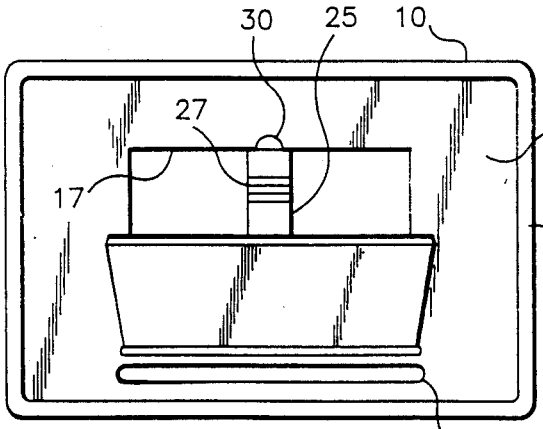
FIG. 1 is a top plan view of the combination bath tub shelf and bench with the reading easel in its upright position.
Figure 2:
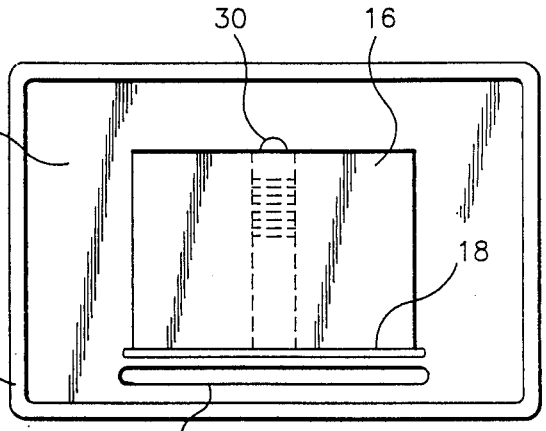
FIG. 2 is a top plan view of the bath tub shelf and bench with the reading easel in its collapsed state.
Figure 3:
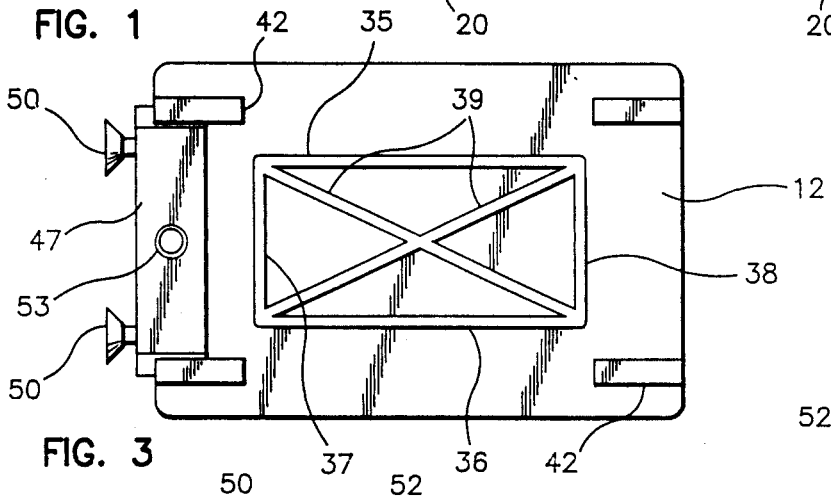
FIG. 3 is a bottom plan view of the combination bath tub shelf and bench.
Figure 4:
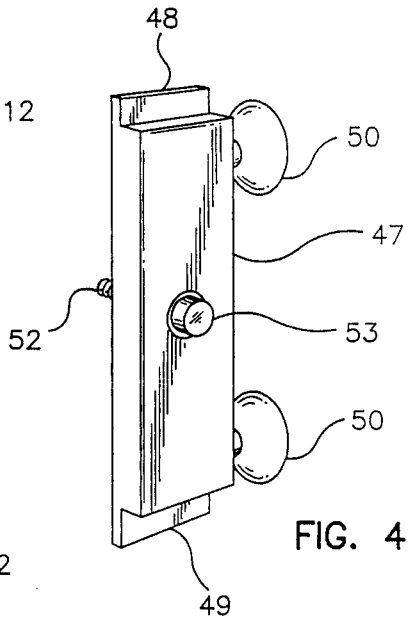
FIG. 4 is an enlarged perspective view of one of the spacer bars.
Figure 5B:
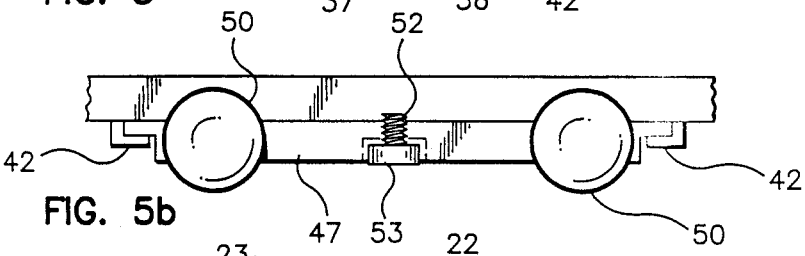
Figure 5A:
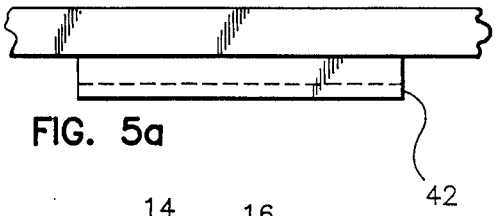
Figure 6:
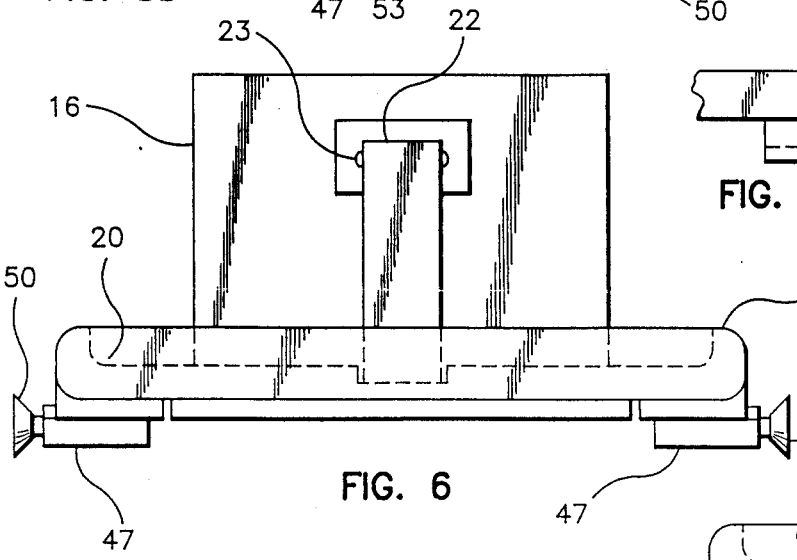

FIG. **5*a*** is an enlarged partial side elevation view of the slide track;

FIG. **5*b*** is an end elevation of the spacer bar telescopically received in the slide track;

FIG. 6 is a rear elevation view of FIG. 1; and

Figure 7:
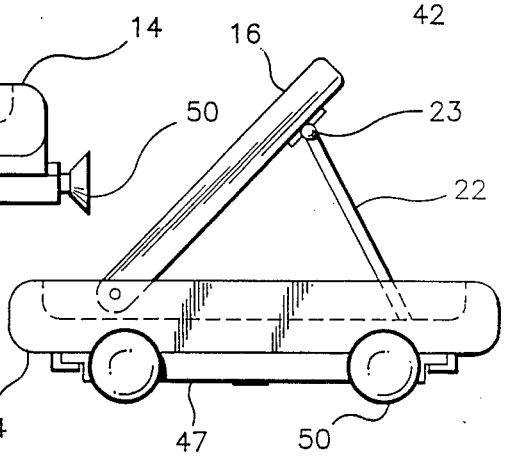

FIG. 7 is a side elevation view of FIG. 1.

DESCRIPTION OF THE PREFERRED EMBODIMENT

Applicant's novel combination bath tub shelf and bench will now be described by referring to FIGS. 1–7 of the drawing. The combination bath tub shelf and bench is generally designated numeral 10.

Combination bath tub shelf and bench 10 is formed from a shelf member 12 having a raised lip structure 14 extending upwardly from the top surface of shelf member 12 and it extends around the entire perimeter thereof. A reading easel 16 has its bottom end attached to a hinge 18 that is located in recess 17. When reading easel 16 is in its collapsed state, its top surface is flush with the top surface of shelf member 12. An elongated groove 20 is positioned immediately forwardly of hinge member 18 and it receives the bottom edge of a book or other reading material which is rested against the reading easel when it is in its upright position.

A bracket 23 is attached to the back surface of reading easel 16 and it has a support leg 22 pivotally attached thereto. A recessed channel 25 is formed in recess 17 for receiving support leg 22 when the reading easel is in its collapsed state. A plurality of slots 27 are formed in recess 25 to provide different angulation positions for the support leg 22. A finger recess 30 is provided at the forward end of reading easel 16 to make it easier to lift it out of recess 17.

The bottom surface shelf member 16 has an integrally formed X-shaped grid like reinforcing frame 34. It is formed from a front wall 35, a rear wall 36, end walls 37 and gussets 39.

Also attached to the bottom surface shelf member 12 are two identical sets of laterally spaced L-shaped side tracks 42. They function to slidably receive position securing assemblies 45. The position securing assemblies are formed from a spacer bar 47 having a slide tab 48 and a slide tab 49 extending laterally from its respective ends. These tabs slide in the respective slide tracks 42. Suction cups 50 are attached to the outer face of spacer bars 47. An internally threaded bore 52 has a set screw 53 threaded therein for tightening the position securing assembly in a locked position.

The drawings as shown and as thusly described are the preferred embodiment of the invention. It would be obvious to one skilled in the art that modifications and changes, simple or complex, could be made to the preferred embodiment which would change the appearance of the invention but not alter the scope, spirit and intention of the invention. It is the intention of the inventor to preclude the occurrence of such modifications in design to the preferred embodiment through the following claims.

I therefore claim:

1. A combination bathtub shelf and bench comprising:

an elongated shelf member having a front edge, a rear edge and laterally spaced side edges, said shelf member having a flat top surface, a flat bottom surface and a predetermined length that spans the width of a bathtub;

a raised lip structure formed integrally with said shelf member and it extends upwardly from the top surface of said shelf member around its entire perimeter;

a reading easel having a front edge, a rear edge and laterally spaced side edges, said reading easel also having a top surface and a bottom surface;

the top surface of said shelf member has a recess formed therein in the configuration of said reading easel so that in its stored position the top surface of said easel is flush with the top surface of said shelf member;

a hinge member pivotally securing the front edge of said reading easel to the top surface of said shelf member adjacent its front edge, said hinge member being located in the recess that receives said reading easel;

a support leg having its top end pivotally hinged to the rear surface of said reading easel;

means cooperating with a bottom end of said support leg for securing said reading easel at various angles of inclination to the top surface of said shelf member;

means on the bottom surface of said shelf member for detachably securing said combination bathtub shelf and bench to the lateral side walls of a bathtub so that said shelf will not slide longitudinally along the length of the bathtub, said means comprising two position securing assemblies, one position securing assembly is mounted adjacent one side edge of said shelf member and the other position securing assembly is mounted adjacent the other side edge of said shelf member, two pairs of laterally spaced L-shaped side tracks are mounted on the bottom surface of said shelf member adjacent its respective side edges and they slidably receive said respective position securing assemblies, said position securing assemblies each being formed of a spacer bar having a slide tab extending laterally from its respective ends that slide in said respective pairs of L-shaped side tracks; and means on the bottom surface of said shelf member for structurally reinforcing said shelf so that it may function as a bench on which a person can sit in a bathtub while bathing, said reinforcing means comprising an integrally formed grid like reinforcing frame having a front wall, a rear wall, laterally spaced end walls and a pair of diagonally extending intersecting gussets.

2. A combination bath tub shelf and bench as recited in claim 1 wherein said means for securing said reading easel at various angles of inclination comprises a plurality of longitudinally spaced slots in the top surface of said shelf member.

3. A combination bath tub shelf and bench as recited in claim 1 where said position securing assemblies each have at least one suction cup for detachable securement to the lateral side walls of a bath tub.

* * * * *